US008033548B2

(12) United States Patent
Shigeta

(10) Patent No.: US 8,033,548 B2
(45) Date of Patent: Oct. 11, 2011

(54) PLAYING CARDS AND TABLE GAME SYSTEM

(75) Inventor: Yasushi Shigeta, Osaka (JP)

(73) Assignee: Angel Playing Cards Co., Ltd. (JP)

( * ) Notice: Subject to any disclaimer, the term of this patent is extended or adjusted under 35 U.S.C. 154(b) by 145 days.

(21) Appl. No.: 12/626,822

(22) Filed: Nov. 27, 2009

(65) Prior Publication Data

US 2010/0133754 A1 Jun. 3, 2010

(30) Foreign Application Priority Data

Nov. 28, 2008 (JP) ..... 2008-304551

(51) Int. Cl.
*A63F 1/14* (2006.01)
*A63F 1/00* (2006.01)

(52) U.S. Cl. ..... 273/293; 273/309; 273/303; 273/304; 273/305; 273/149 R; 273/292; 463/12; 463/13

(58) Field of Classification Search ..... 273/309, 273/293, 303, 304, 305, 149 R; 463/11–13
See application file for complete search history.

(56) References Cited

U.S. PATENT DOCUMENTS 4,513,696 A 4/1985 Fujii et al.
4,513,969 A 4/1985 Samsel, Jr.
4,534,562 A 8/1985 Cuff
4,586,712 A 5/1986 Lorber et al.
4,794,239 A 12/1988 Allais
5,067,713 A 11/1991 Soules et al.
5,166,502 A 11/1992 Rendleman et al.
5,169,155 A 12/1992 Soules et al.
5,259,907 A 11/1993 Soules et al.
5,331,141 A 7/1994 Kaneko
5,374,061 A 12/1994 Albrecht
(Continued)

FOREIGN PATENT DOCUMENTS

JP H5-398 1/1993
(Continued)

OTHER PUBLICATIONS

Non-Final Office Action dated Dec. 8, 2010 issued to U.S. Appl. No. 11/884,021.

(Continued)

*Primary Examiner* — Benjamin Layno
(74) *Attorney, Agent, or Firm* — Amster, Rothstein & Ebenstein LLP

(57) ABSTRACT

The present invention provides playing cards which allow a code to be read reliably from the cards shot out at various speeds. Playing cards (1) are provided with a code (2) not readable under a lighting condition of visible light, but readable under lighting conditions other than the visible light. The code (2) comprises four code elements (3) arranged in two rows and two columns and represents suit and rank information of the playing cards (1). The code elements (3) include at least two types of mark which differ in length in a column direction corresponding to a reading direction of the code (2). Row-by-row combinations of the code elements (3) arranged in a row direction orthogonal to the code reading direction can be identified uniquely and the suit and rank information of the playing cards (1) represented by the code (2) can be identified based on the row-by-row combinations of the code elements (3).

14 Claims, 9 Drawing Sheets

U.S. PATENT DOCUMENTS

| | | | | |
|---|---|---|---|---|
| 5,669,816 | A | 9/1997 | Garczynski | |
| 5,707,287 | A | 1/1998 | McCrea, Jr. | |
| 5,722,893 | A | 3/1998 | Hill et al. | |
| 5,779,546 | A | 7/1998 | Meissner | |
| 5,814,804 | A | 9/1998 | Kostizak | |
| 5,911,626 | A | 6/1999 | McCrea, Jr. | |
| 5,941,769 | A | 8/1999 | Order | |
| 6,039,650 | A | 3/2000 | Hill | |
| 6,042,150 | A | 3/2000 | Daley | |
| 6,066,857 | A | 5/2000 | Fantone et al. | |
| 6,093,103 | A | 7/2000 | McCrea, Jr. | |
| 6,098,892 | A | 8/2000 | Peoples, Jr. | |
| 6,126,166 | A | 10/2000 | Lorson et al. | |
| 6,217,447 | B1 | 4/2001 | Lofink et al. | |
| 6,270,406 | B1 | 8/2001 | Sultan | |
| 6,460,848 | B1 | 10/2002 | Soltys et al. | |
| 6,527,191 | B1 | 3/2003 | Jannersten | |
| 6,582,301 | B2 | 6/2003 | Hill | |
| 6,588,751 | B1 | 7/2003 | Grauzer et al. | |
| 6,629,894 | B1 | 10/2003 | Purton | |
| 6,638,161 | B2 | 10/2003 | Soltys et al. | |
| 7,029,009 | B2 | 4/2006 | Grauzer et al. | |
| 7,093,130 | B1 | 8/2006 | Kobayashi | |
| 7,172,507 | B2 | 2/2007 | Fujimoto | |
| 7,222,852 | B2 | 5/2007 | Soltys et al. | |
| 2002/0068635 | A1 | 6/2002 | Hill | |
| 2002/0155869 | A1 | 10/2002 | Soltys et al. | |
| 2002/0163125 | A1 | 11/2002 | Grauzer et al. | |
| 2002/0165029 | A1 | 11/2002 | Soltys et al. | |
| 2003/0171142 | A1 | 9/2003 | Kaji et al. | |
| 2003/0176209 | A1 * | 9/2003 | Soltys et al. | 463/13 |
| 2003/0195025 | A1 | 10/2003 | Hill | |
| 2004/0026636 | A1 | 2/2004 | Shigeta | |
| 2004/0100026 | A1 | 5/2004 | Haggard | |
| 2005/0121852 | A1 | 6/2005 | Soltys et al. | |
| 2005/0137005 | A1 | 6/2005 | Soltys et al. | |
| 2007/0225055 | A1 * | 9/2007 | Weisman | 463/11 |
| 2009/0286597 | A1 * | 11/2009 | Shigeta | 463/29 |

FOREIGN PATENT DOCUMENTS

| | | |
|---|---|---|
| JP | H5-20512 | 1/1993 |
| JP | 9-215812 | 8/1997 |
| JP | 2001222687 | 8/2001 |
| JP | 2002165916 | 6/2002 |
| JP | 2002224443 | 8/2002 |
| JP | 2003052902 | 2/2003 |
| JP | 2003070956 | 3/2003 |
| JP | 2003144742 | 5/2003 |
| JP | 2003250950 | 9/2003 |
| JP | 2005198668 | 7/2005 |
| JP | 2005267625 | 9/2005 |
| JP | 2005-296634 | 10/2005 |
| JP | 2007236995 | 9/2007 |
| JP | 2008188471 | 8/2008 |
| JP | 2005-061255 | 10/2009 |
| WO | 9614115 | 5/1996 |
| WO | 0156670 | 8/2001 |
| WO | 02064225 | 8/2002 |
| WO | 03026763 | 4/2003 |

OTHER PUBLICATIONS

Final Office Action dated Dec. 8, 2010 issued to U.S. Appl. No. 12/231,657.

Non-Final Office Action dated Nov. 23, 2010 issued to U.S. Appl. No. 12/825,261.

Final Office Action dated Apr. 14, 2010 issued to U.S. Appl. No. 10/542,073.

Non-Final Office Action dated Oct. 1, 2010 issued to U.S. Appl. No. 11/929,727.

Non-Final Office Action dated Mar. 19, 2010 issued to U.S. Appl. No. 12/231,657.

* cited by examiner

| Combination | Positional Relationship of Marks |
|---|---|
| 1 | |
| 2 | |
| 3 | |
| 4 | |
| 5 | |
| 6 | |
| 7 | |
| 8 | |
| 9 | |

FIG. 2

| Combination | Positional Relationship of Marks | Sensor Output |
|---|---|---|
| 1 | | OFF<br>OFF |
| 2 | | OFF<br>ON OFF |
| 3 | | ON OFF<br>OFF |
| 4 | | ON OFF<br>ON OFF |
| 5 | | ON OFF<br>ON OFF |
| 6 | | OFF ON OFF<br>ON OFF |
| 7 | | OFF ON OFF<br>ON OFF |
| 8 | | ON OFF<br>ON OFF |
| 9 | | ON OFF<br>ON OFF |

FIG. 9

PLAYING CARDS AND TABLE GAME SYSTEM

BACKGROUND OF THE INVENTION

1. Field of the Invention

The present invention relates to a table game system equipped with playing cards and a card shooter apparatus, and more particularly, to a playing card reading technique suitable for use in table games.

2. Description of the Related Art

In baccarat and other table games, since rules which determine the outcome of the games are complicated, a dealer who deals playing cards on a game table might make an error in deciding the outcome of a game. Besides, players taking part in a table game might switch dealt cards.

To deal with this situation, a technique has been proposed that uses playing cards bearing a code, which having been printed on the front side of the cards (side on which a suit and rank are printed), is invisible to the human eye under conditions of normal use, but identifiable by a predetermined identification device as well as uses a card shooter apparatus which has a capability to read the code out of the playing cards by being provided on a game table (e.g., Japanese Patent Laid-Open No. 2005-296634).

With the playing cards and card shooter apparatus described above, since the card shooter apparatus can determine the outcome of games if rules for that are stored therein, any error made by dealers in deciding the outcome can be detected.

Also, since dealt cards can be read and checked by the card shooter apparatus, it is possible to prevent cheating such as card substitution by players or the like.

However, in card games using playing cards, due to the nature of the card games, cards are shot out quickly by the hand of a dealer at times, and slowly by a card shooter apparatus at other times. Consequently, readers which read playing cards in a state of rest (e.g., barcode readers) are unsuitable for reading a code from cards in a state of motion (unsuitable for use in table games). Also, code readers which read a code from cards on the assumption that playing cards move at a certain speed by being shot out from a machine are not suitable for reading a code from cards shot out at various speeds (e.g., because of possible read errors).

SUMMARY OF THE INVENTION

The present invention has been made to solve the above problem and has an object to provide playing cards and a table game system which allow a code to be read reliably from the cards shot out at various speeds.

Playing cards according to the present invention are provided with a code not readable under a lighting condition of visible light, but readable under lighting conditions other than the visible light, wherein: the code, which comprises a plurality of code elements arranged in at least two rows and two columns, represents at least suit and rank information of the playing cards; the code elements include at least two types of mark which differ in length in a column direction corresponding to a reading direction of the code; row-by-row combinations of the code elements arranged in a row direction orthogonal to the code reading direction can be identified uniquely; and the suit and rank information of the playing cards represented by the code can be identified based on the row-by-row combinations of the code elements.

Consequently, during reading of the code which comprises the code elements arranged in a matrix (at least two rows and two columns), the code elements arranged in a row direction (orthogonal to the code reading direction) are read on a row by row basis. The code elements include at least two types of mark which differ in length in the column direction (corresponding to the reading direction of the code) and the row-by-row combinations of the code elements can be identified uniquely. Thus, even if the playing cards are shot out at various speeds, the suit and rank information of the playing cards can be identified reliably based on the row-by-row combinations of the code elements. This makes it possible to reliably read the code from the playing cards shot out at various speeds.

Also, in the playing cards according to the present invention, the row-by-row combinations of the code elements may include the presence or absence of the marks in each row, or a combination of relative column-direction positions of the marks in each row and the types of the marks.

Consequently, it is possible to uniquely identify the presence or absence of the marks in each row, or a combination of relative column-direction positions of the marks in each row and the types of the marks. Based on this, the suit and rank information of the playing cards can be identified reliably. This makes it possible to reliably read the code from the playing cards shot out at various speeds.

Also, in the playing cards according to the present invention, the code may represent information about a group to which the playing cards belong.

Consequently, the group to which the playing cards belong can be identified. This makes it possible to detect any playing card belonging to another group if used (fraudulently).

Also, in the playing cards according to the present invention, the code may include the code elements arranged in three rows and two columns or arranged in two rows and three columns.

Also, in the playing cards according to the present invention, the group may include a plurality of decks of the playing cards.

Also, in the playing cards according to the present invention, the code may represent casino information unique to a casino in which the playing cards are used.

Consequently, the casino in which the playing cards are used can be identified. This makes it possible to detect any playing card belonging to another casino if used (fraudulently).

Also, in the playing cards according to the present invention, the code may be located at least two locations on each of the playing cards point-symmetrically with respect to the center of the playing card.

Consequently, the code can be read regardless of orientation of the playing card (even when the playing card is upside down).

Also, in the playing cards according to the present invention, the code may be printed on the playing cards using a paint which is visualized upon exposure to ultraviolet radiation.

Also, in the playing cards according to the present invention, the code may be printed in those locations of the playing cards which do not overlap with suit and rank symbols.

Consequently, it is possible to prevent interference by the symbols on the playing cards when reading the code.

Also, in the playing cards according to the present invention, a blank space may be provided between the code and edge of the playing card.

A table game system according to the present invention comprises playing cards provided with a code not readable under a lighting condition of visible light, but readable under lighting conditions other than the visible light, and a card shooter apparatus which has a capability to read the code out of the playing cards by being provided on a game table, wherein: the code of the playing cards comprises a plurality of code elements arranged in at least two rows and two columns and represents at least suit and rank information of the playing cards; the code elements include at least two types of mark which differ in length in a column direction corresponding to a reading direction of the code; row-by-row combinations of the code elements arranged in a row direction orthogonal to the code reading direction can be identified uniquely; the suit and rank information of the playing cards represented by the code can be identified based on the row-by-row combinations of the code elements; and the card shooter apparatus comprises: a card guide unit which guides the playing cards drawn one by one out of a card receptacle unit onto the game table, at least two code sensors which is placed at locations corresponding to columns of the code elements on the playing cards guided and moved by the card guide unit, and read the code elements out of the playing cards on a row by row, an identification means which identifies the suit and rank information of the playing cards represented by the code based on the row-by-row combinations of the code elements read by the at least two code sensors, a determination means which determines results of a card game based on the suit and rank information of the playing cards identified by the identification means, and a first output means which outputs the results produced by the determination means.

With the table game system, as with the playing card described above, even if the playing cards are shot out at various speeds, the suit and rank information of the playing cards can be identified reliably based on the row-by-row combinations of the code elements. This makes it possible to reliably read the code from the playing cards shot out at various speeds.

Also, in the table game system according to the present invention, the code may be able to represent information about a group to which the playing cards belong; the identification means may be able to identify information about the group to which the playing cards belong based on the row-by-row combinations of the code elements read by the at least two code sensors; and the card shooter apparatus may further comprise: a detection means which detects playing cards not belonging to the group, based on the information about the group of the playing cards identified by the identification means, and a second output means which outputs detection results produced by the detection means.

Consequently, the group to which the playing cards belong can be identified, making it possible to detect any playing card belonging to another group if used (fraudulently).

Also, in the table game system according to the present invention, each of the at least two code sensors may output a detection signal corresponding to the read row-by-row combinations of the code elements; and the identification means may identify the suit and rank information of the playing cards represented by the code based on relative changes of the detection signals of the at least two code sensors.

Consequently, the suit and rank information of the playing cards can be identified easily based on the relative changes of the detection signals of the at least two code sensors.

Also, in the table game system according to the present invention, the first output means may include a monitor provided on a side of a housing of the card shooter apparatus.

The present invention makes it possible to reliably read the code from the playing cards shot out at various speeds.

BRIEF DESCRIPTION OF THE DRAWINGS

FIG. 2 is a diagram showing an example of combinations (positional relationship) of marks;

FIG. 9 is a diagram showing an example of sensor outputs concerning combinations (positional relationship) of marks.

DETAILED DESCRIPTION OF THE PREFERRED EMBODIMENTS

Playing cards and a table game system according to an embodiment of the present invention will be described below with reference to the drawings. In the present embodiment, a table game system used in baccarat and other table games will be described by way of example.

The table game system according to the present embodiment includes playing cards (also referred to simply as cards) and a card shooter apparatus. First, a configuration of the playing cards will be described below with reference to FIGS. 1 to 3.

Figure 1:
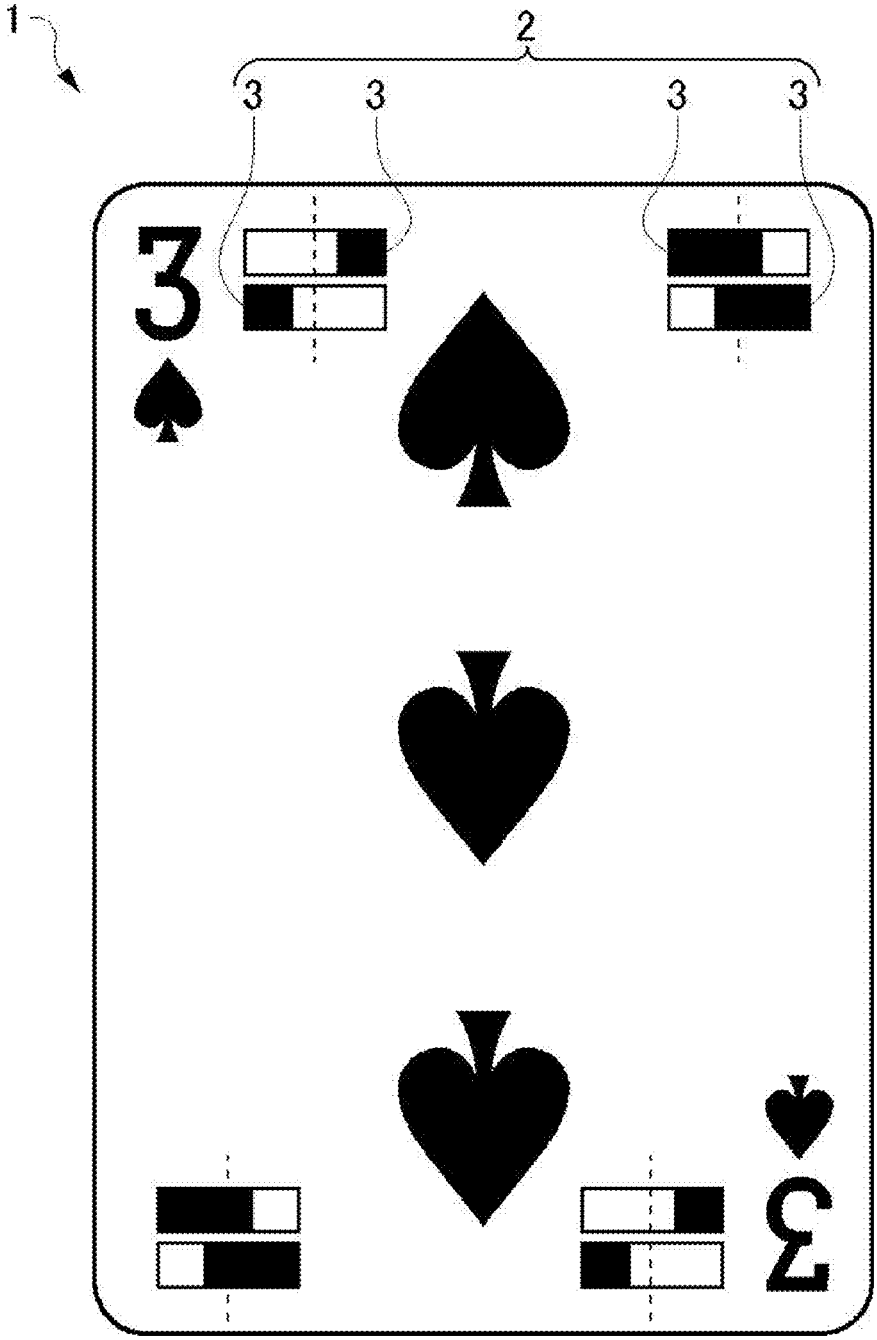
FIG. 1 is an explanatory diagram of a playing card according to the present embodiment.

FIG. 1 is a diagram showing an example of the playing cards according to the present embodiment. As shown in FIG. 1, a two row by two column code 2 is printed on each short side (top side and bottom side in FIG. 1) of a playing card 1. In this example, the direction along the short sides of the card is designated as a column direction while the direction along the long sides of the card is designated as a row direction. In this case, the card is shot out in a direction along the short sides and the code 2 is read along the direction in which the card is shot out. Thus, it can be said that the column direction (horizontal direction in FIG. 1) corresponds to the reading direction of the code 2. On the other hand, it can be said that the row direction (vertical direction in FIG. 1) is orthogonal to the reading direction of the code 2.

In the example of FIG. 1, the code 2 is placed at two locations: the top side and bottom side of the playing card 1. The code 2 is placed on the top side and bottom side point-symmetrically to each other with respect to the center of the playing card 1. Also, as shown in FIG. 1, the code 2 is printed in those locations of the playing card 1 which do not overlap with symbols of a suit (e.g., "spade") and rank (e.g., "3") normally printed in ink. Also, blank spaces are provided between the code 2 and edge of the playing card 1.

The code 2 is printed using a paint (ultraviolet ink) which is visualized upon exposure to ultraviolet radiation. That is, the code 2 is not readable under a condition of visible light, but readable under a condition of ultraviolet light. Thus, under conditions of normal use, the code 2 is invisible to the human eye, but identifiable by a predetermined identification device.

Now, a configuration of the code 2 will be described in detail with reference to drawings. The code 2 comprises four code elements 3 arranged in two rows and two columns. A combination of the four code elements 3 represents the suit and rank information of the playing card 1. Two types of mark (long mark and short mark) which differ in length in the column direction (horizontal direction in FIG. 1) are used as the code elements 3. In FIG. 1, marks are illustrated as black rectangles (the long mark is shown as a long black rectangle and the short mark is shown as a short black rectangle). The code elements 3 are configured such that "row-by-row combinations of the code elements 3" arranged in a row direction (vertical direction in FIG. 1) can be identified uniquely.

"The row-by-row combinations of the code elements 3," which are a feature of the present invention, will be described in detail with reference to FIG. 2. FIG. 2 is a diagram showing an example of combinations of the code elements 3 in a row. In FIG. 2, the code elements 3 in the first column (outer column) are illustrated on the upper side and the code elements 3 in the second column (inner column) are illustrated on the lower side. Incidentally, a reference position of each row is indicated by a broken line. The code elements 3 in each row are placed at predetermined relative positions (relative positions in the column direction) around the reference position.

In the example of FIG. 2, a first combination is "no mark, no mark." A second combination is "no mark, short mark." A third combination is "short mark, no mark." In this case, it can be said that the row-by-row combinations of the code elements 3 are expressed as the presence or absence of marks in each row. That is, the code elements 3 also include "no mark."

Also, in the example of FIG. 2, a fourth combination is "short mark, long mark" and a fifth combination is "long mark, short mark." The fourth and fifth combinations are combinations of long and short marks, but the two combinations are inverted from each other. In this case, the long mark and short mark are placed by being aligned in relation to the reference position of the row (that there will be no displacement in the column direction). In this case, it can be said that the row-by-row combinations of the code elements 3 are expressed as combinations of relative column-direction positions of the marks in each row and the types of the marks (short mark and long mark).

On the other hand, a sixth combination comprises two "short marks" located at positions displaced from the reference position of the row (in such a way as not to overlap at the reference position). A seventh combination comprises two "long marks" located at positions displaced from the reference position of the row (in such a way as to overlap at the reference position). Eighth and ninth combinations are bilaterally symmetric to the sixth and seventh combinations, respectively. The sixth and eighth combinations contain separated, non-overlapping upper and lower marks which differ in their positions. The seventh and ninth combinations contain overlapping upper and lower marks which differ in their manner of displacement. Again, it can be said that the row-by-row combinations of the code elements 3 are expressed as combinations of relative column-direction positions of the marks in each row and the types of the marks (short mark and long mark).

In this way, the code 2 is configured to be a predetermined code containing such combinations of code elements 3 that can be identified by relative positional relationship of the code elements 3 between different rows or columns or based on difference in the number or shape of code elements 3.

In this case, the code elements 3 in one row have nine possible combinations. Since one code 2 comprises two combinations (two rows) of the code elements 3, one code 2 has 81 (9×9) possible combinations. Since there are 52 playing cards 1 in total, the code 2 which has 81 combinations can express all the suits and ranks of the 52 playing cards 1.

The remaining 29 (=81−52) combinations of the 81 combinations of code 2 may be used as a group code to represent a group to which the playing cards 1 belong. When a group includes multiple decks, the remaining 29 combinations may be used as a group code to represent a "group containing multiple decks." Also, the group code may include casino information unique to a casino in which the playing cards 1 are used. Incidentally, in baccarat games, "J," "Q," and "K" are treated as equal to "10." Therefore, the same code as the one assigned to "10" may be assigned to "J," "Q," and "K."

Figure 3:
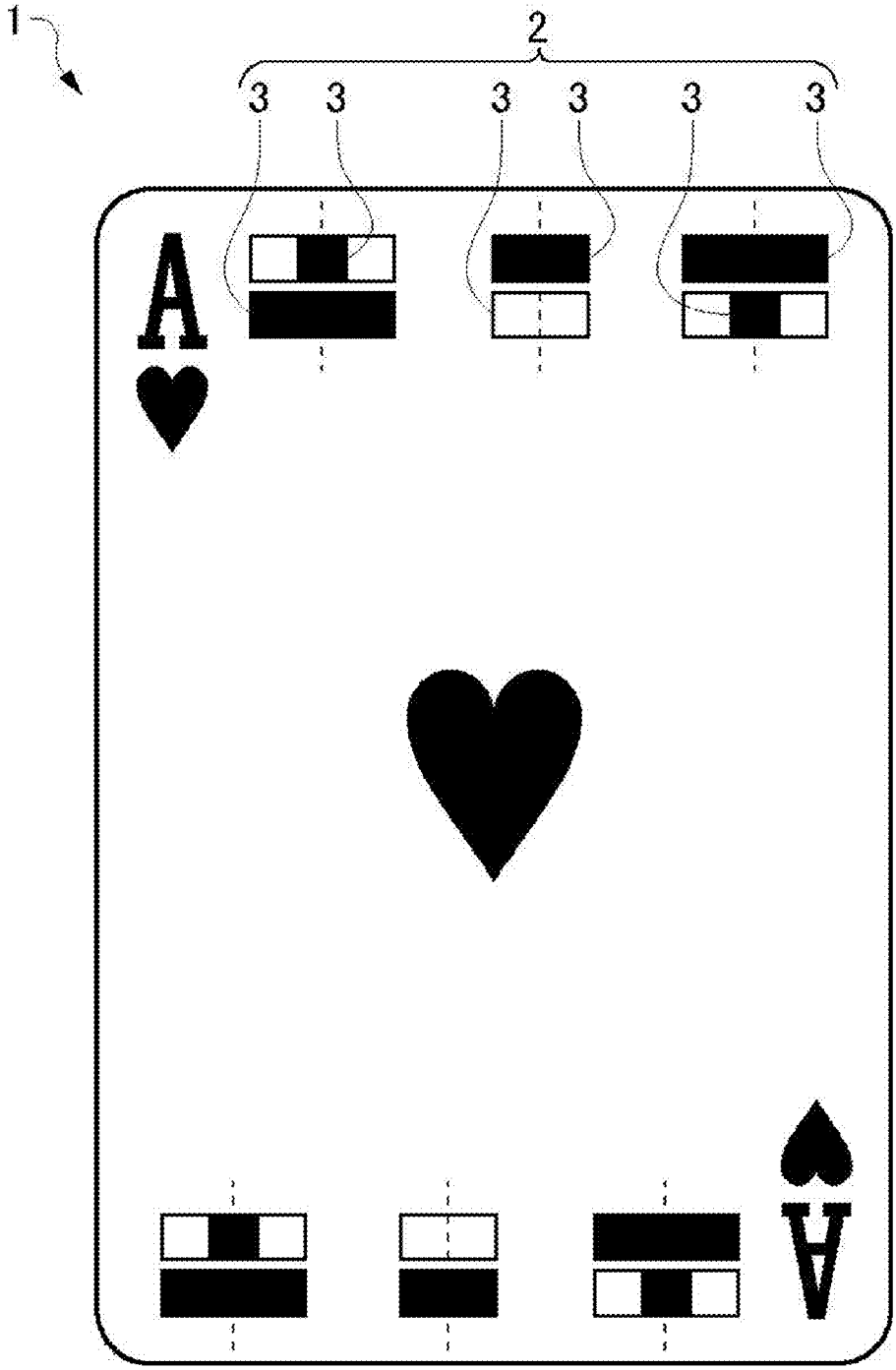
FIG. 3 is an explanatory diagram illustrating a variation of the playing card.

Also, the group code may be printed on the card separately from the two row by two column code 2. FIG. 3 is a diagram showing a variation of the playing card 1. In the variation in FIG. 3, a three row by two column code 2 is printed on the card. Of the three row by two column code 2, the two row by two column code 2 (the right and left rows excluding the center row) corresponds to the code 2 in FIG. 1 while the one row by two column code in the center (the center row) is used as a group code. Combinations of code elements in the code are not limited to these forms, and may be changed or modified within the scope of the present invention. That is, the code may have any combination of code elements (e.g., a two row by three column code) as long as the code can represent information needed for the game (such as suit and rank information of cards or group information).

Next, a configuration of the card shooter apparatus will be described with reference to FIGS. 4 to 8. The card shooter apparatus has a capability to read the code 2 out of the playing cards 1 by being provided on a game table T.

Figure 4:
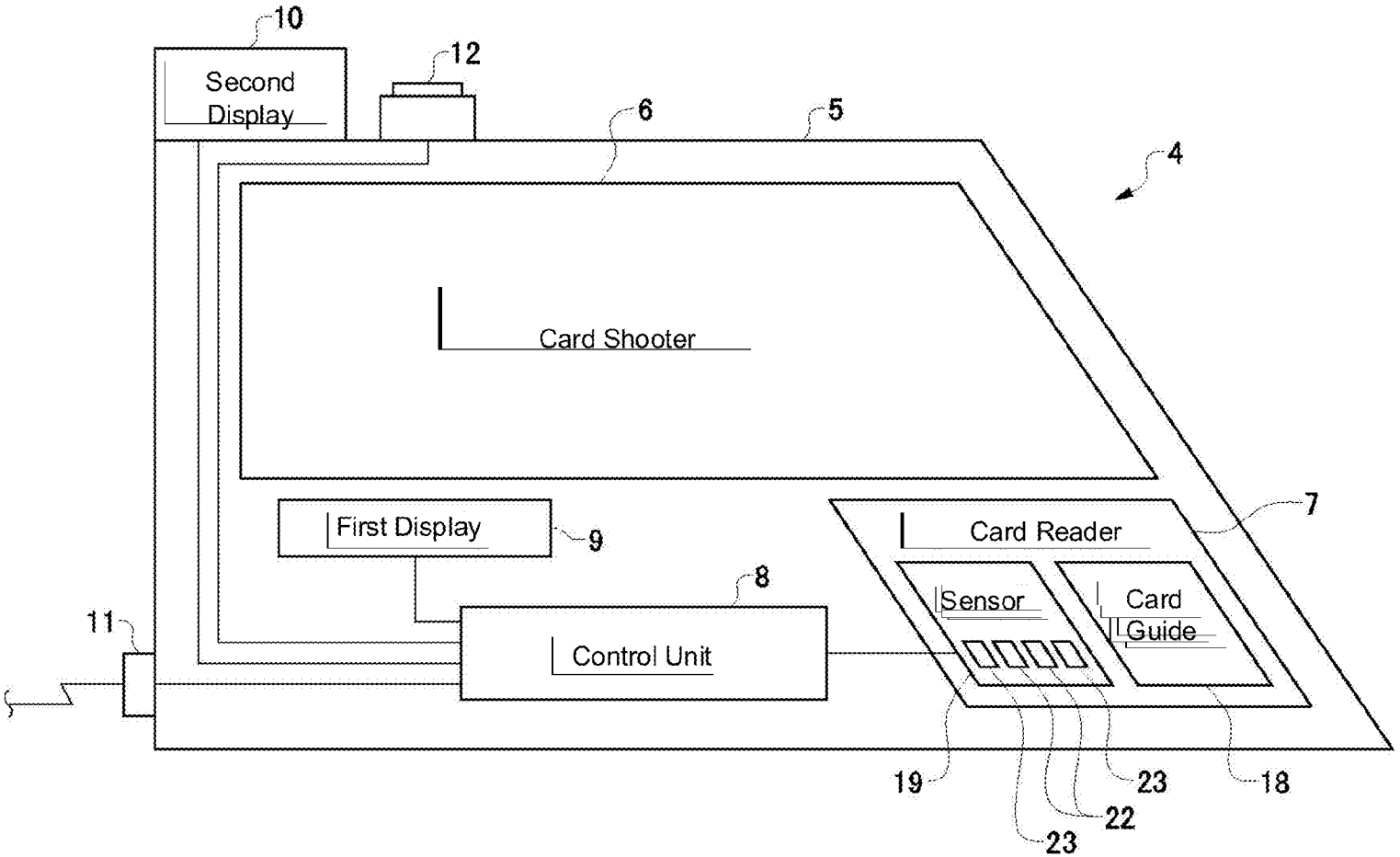
FIG. 4 is a diagram showing a configuration of a card shooter apparatus according to the present embodiment.

FIG. 4 is a diagram for illustrating the configuration of the card shooter apparatus according to the present embodiment. As shown in FIG. 4, the card shooter apparatus 4 includes a housing 5 which contains a card shooter unit 6 and card reader unit 7. It can be said that the card shooter apparatus 4 is a combination of the card shooter unit 6 and card reader unit 7 in one system. Also, as shown in FIG. 4, the card shooter apparatus 4 includes a control unit 8, first display unit 9, and second display unit 10. Furthermore, the card shooter apparatus 4 includes a communications terminal 11 and transmit permission button 12.

Figure 5:
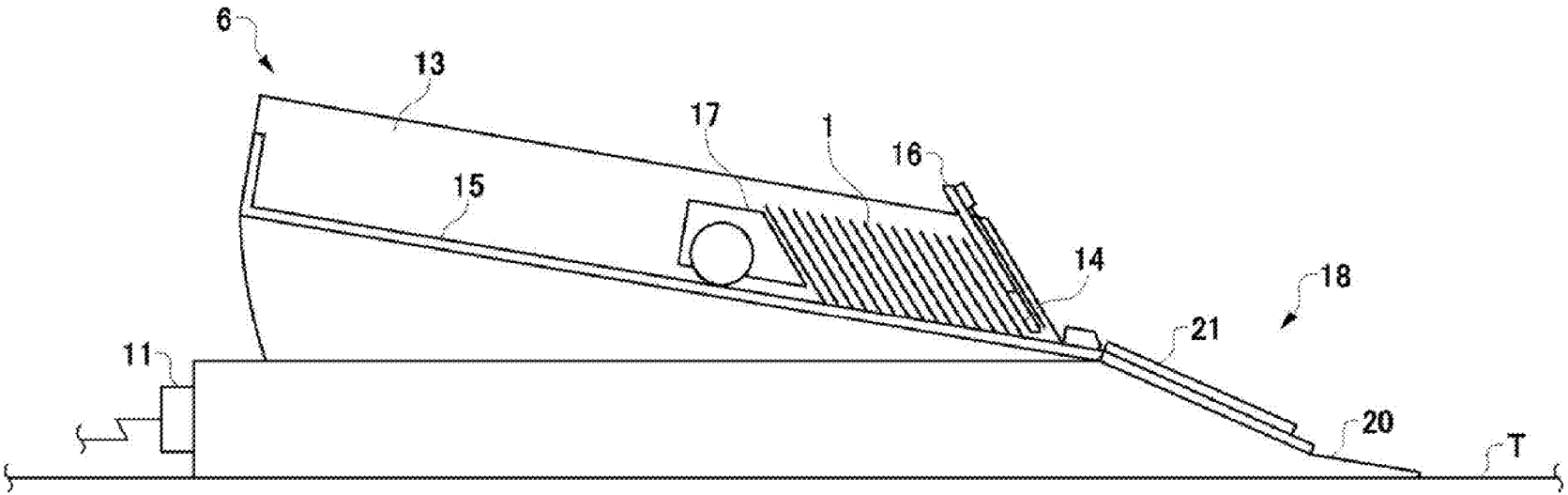
FIG. 5 is a side view for illustrating the configuration of the card shooter unit.
Figure 6:
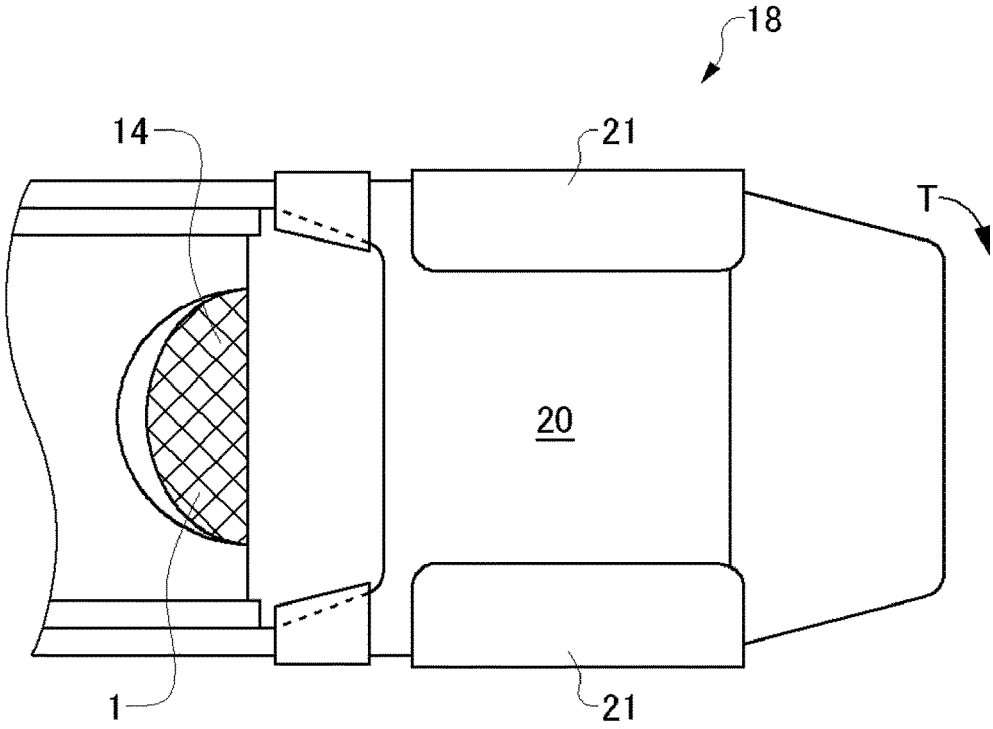
FIG. 6 is a plan view for illustrating the configuration of the card reader unit.

First, a configuration of the card shooter unit 6 will be described. FIG. 5 is a side view for illustrating the configuration of the card shooter unit 6. FIG. 6 is a plan view showing principal part of the card shooter unit 6 to illustrate the configuration of the card shooter unit 6. As shown in FIGS. 5 and 6, the card shooter unit 6 includes a card receptacle 13 which houses multiple cards and an opening 14 which allows the cards to be taken out of the card receptacle 13 by sliding.

A floor 15 and front wall 16 of the card receptacle 13 are inclined as shown in FIG. 5. In the card receptacle 13, a bundle of cards is pushed forward by a card pusher 17 with a roller and thereby pressed against the front wall 16. The front wall 16 has a U-shaped opening 14 in its lower part as shown in FIG. 5. The dealer slides a card and takes it out through the opening 14.

Incidentally, black cloth (not shown) is put on the front wall 16 to cover the opening 14. Also, a cover is mounted on top of the card shooter apparatus 4. The card shooter apparatus 4 is made of resin and is generally black in color.

Figure 7:
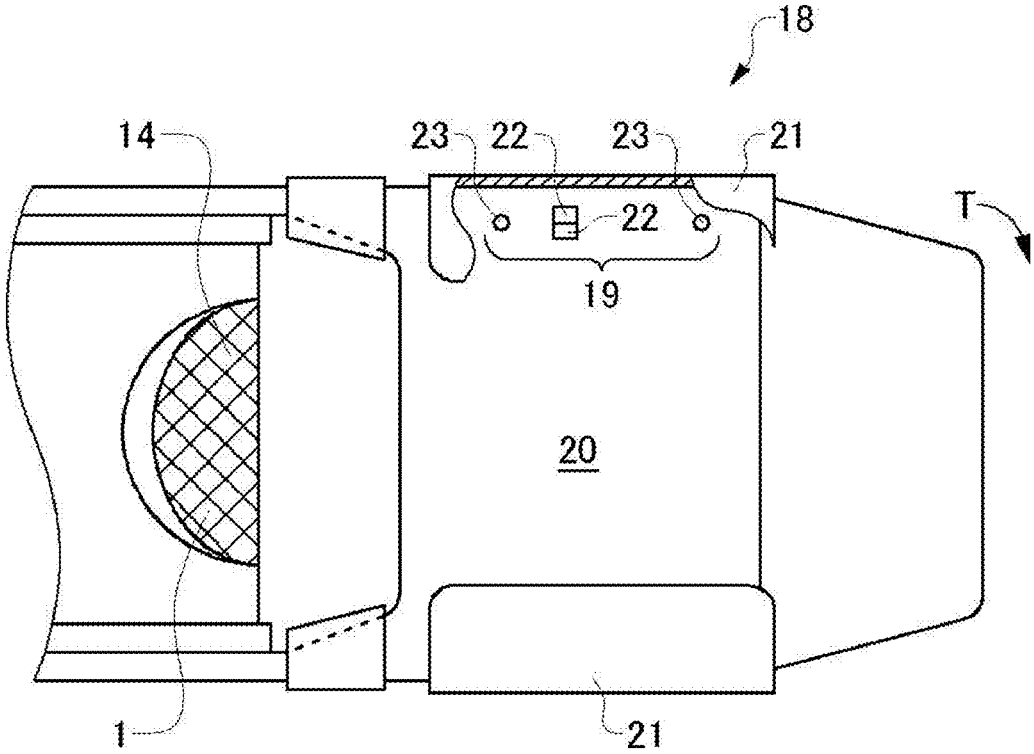
FIG. 7 is a cut-away plan view for illustrating a configuration of a card reader unit.

Next, a configuration of the card reader unit 7 will be described. FIG. 7 is a partially cut-away plan view showing principal part of the card reader unit 7 to illustrate the configuration of the card reader unit 7. As shown in FIG. 7, the card reader unit 7 includes a card guide unit 18 which guides the cards taken one by one out of the opening 14 onto the game table T, and a sensor unit 19 which reads the code 2 out of the cards guided by the card guide unit 18. Incidentally, the sensor unit 19 is provided inside the card guide unit 18, and is not shown in FIG. 6 (see FIG. 7).

The card guide unit 18 is integrally coupled to a structure of a card outlet area of the card shooter unit 6. Although it is assumed by way of example that the card guide unit 18 is attached to the housing 5, the card guide unit 18 may be attached to a card shooter platform (not shown). Also, although it is assumed by way of example that the sensor unit 19 is contained in the housing 5, the sensor unit 19 may be contained in the platform.

The card guide unit 18 has a card guide surface 20 which is an inclined surface, and one end of the card guide surface 20 leads to the opening 14 in the card outlet. The card guide surface 20 extends downward and forward from a card outlet and the other end of the card guide surface 20 leads to the game table T. The card guide surface 20 serves as a measuring surface when the cards are read.

Guide rails 21 are mounted on opposite side edges of the card guide surface 20. A clearance is created between each guide rail 21 and card guide surface 20 to allow passage of a card. The clearances in a card path are set to be slightly larger than the thickness of the card. After being pulled out of the card shooter apparatus 4, the card passes the card guide surface 20. In so doing, opposite edges of the card pass the clearances in the card path.

Each of the two guide rails 21 is detachably mounted with screws or the like (not shown). As shown in FIG. 7, when the guide rails 21 are removed, a sensor unit 19 equipped with four sensors is exposed. The four sensors include two black light sensors 22 and two object detection sensors 23. The four sensors are provided on the card guide surface 20 of the card guide unit 18. The black light sensors 22 are an example of the code sensors according to the present invention.

As shown in FIG. 7, the black light sensors 22 (hereinafter referred to as UV sensors 22) are located on a relatively upstream side in a card flow direction on the card guide surface 20. The object detection sensors 23 are fiber-optic sensors which detect the presence or absence of a card. One of the object detection sensors 23 (on the upstream side) is located on the most upstream side in the card flow direction on the card guide surface 20 and the other object detection sensor 23 (on the downstream side) is located downstream from the upstream-side object detection sensor 23. That is, the two object detection sensors 23 are provided upstream and downstream across reading points of the UV sensors 22 as shown in FIG. 7.

Each of the UV sensors 22 includes a LED (ultraviolet LED) which emits ultraviolet rays and a detector. Ultraviolet rays (black light) are directed at the card and the code 2 on the card is detected by the detector. As described above the code 2 is printed on the card in ultraviolet-luminescent ink which develops a color upon exposure to ultraviolet rays.

The UV sensors 22 are connected to the control unit 8 via a cable. The control unit 8 determines the combinations in the code 2 based on output signals from the detectors of the UV sensors 22. The control unit 8 is contained in the housing 5. Incidentally, a control device (control box) equivalent to the control unit 8 may be provided separately from the card shooter platform.

Now, a configuration of the control unit 8 will be described in more detail. The control unit 8, which is a computer device, is connected with the UV sensors 22 and object detection sensors 23. The control unit 8 is also connected with a monitor of the first display unit 9 and three lamps of the second display unit 10.

As described later, the computer of the control unit 8 has the processing capability to automatically determine the outcome of games. The capability is implemented by an outcome determination program installed on the computer and the program is executed by a processor of the computer.

In a determination process, the computer of the control unit 8 acquires the values of cards taken out of the card shooter unit 6 and placed onto the game table T one after another. The acquired values of cards are stored in a memory 25 successively. Information as to what player is dealt each card is stored at the same time. That is, the values of the cards are stored by being associated with the players who have dealt the cards.

The card shooter apparatus 4 according to the present embodiment is used in baccarat games. In baccarat, there are a Player and Banker. Determinations as to which of the Player and Banker will be dealt a card as well as a determination of the outcome are made uniquely based on the number of cards dealt so far and the values of the card. The computer of the control unit 8 stores the ranks (values) of the dealt cards in the memory 25 by associating them with the players. Then, the computer of the control unit 8 reads the ranks of the cards dealt to the Player and Banker out of the memory 25, sums up the values of the cards, compares the total scores of the two players, and determines a winner, or declares a tie as appropriate.

The control unit 8 outputs game results via the first display unit 9 and second display unit 10. The first display unit 9 displays the read values, game results, and the like. On the other hand, the second display unit 10 turns on one of a Banker's Win lamp, Tie lamp, and Player's Win lamp based on the game results. In this case, the first display unit 9 is an example of the first output means according to the present invention and the second display unit 10 is an example of the second output means according to the present invention.

The first display unit 9 displays cards' values and game information under the control of the control unit 8. The first display unit 9 is a so-called monitor. The second display unit 10 is equipped with three lamps, namely, the Player's Win lamp (red), Tie lamp (yellow), and Banker's Win lamp (green). The lamps are turned on to indicate the outcome of the game under the control of the control unit 8. That is, the second display unit 10 can be called an outcome indicator.

According to the present embodiment, the monitor of the first display unit 9 is provided on a side of the housing 5 and the lamps of the second display unit 10 are provided in rear part on top of the housing 5.

The communications terminal 11 is an interface which transmits read data read out of cards by the sensor unit 19 and processed by the control unit 8 to a game monitoring pit which monitors game tables T or to a central monitoring room. The transmit permission button 12 is provided on top of the housing 5 and pressed by the dealer (operator) or the like at a game table T to permit transmission of read data.

Figure 8:
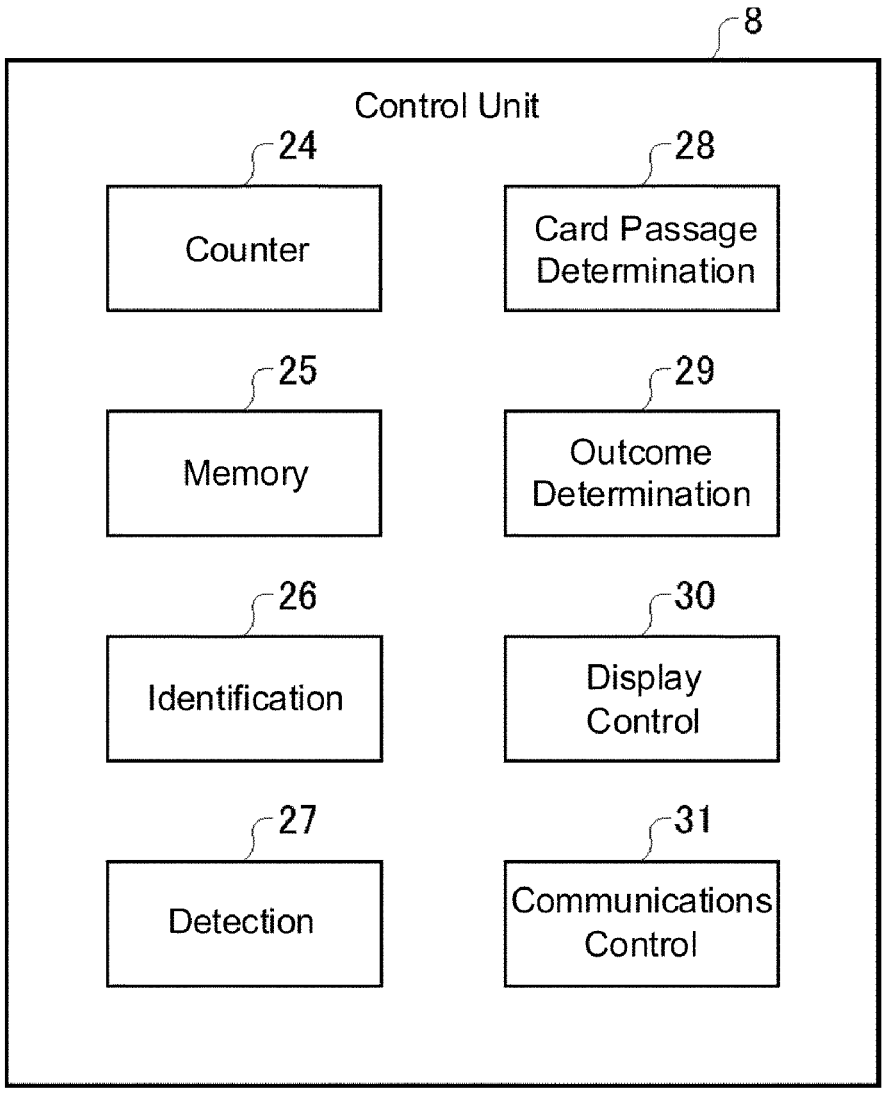
FIG. 8 is a block diagram for illustrating a configuration of a control unit.

Now, functions of the control unit 8 will be described in detail with reference to a functional block diagram in FIG. 8. FIG. 8 is a functional block diagram of the control unit 8. As shown in FIG. 8, the control unit 8 includes a counter 24, memory 25, identification unit 26, and detection unit 27. Also, the control unit 8 includes a card passage determination unit 28, outcome determination unit 29, display control unit 30, and communications control unit 31.

The counter 24 has a capability to count detection signals (ON signals) received from the UV sensors 22 and determine the number of marks. The memory 25 temporarily holds the read data read out of cards by the sensor unit 19 and processed by the control unit 8.

The identification unit 26 has a capability to identify card information (such as suit and rank information of each card 1 or group information) represented by the code 2, based on the row-by-row combinations of code elements 3 read by the UV sensors 22. The detection unit 27 has a capability to detect playing cards (fraudulent cards) not belonging to the group based on group information identified by the identification unit 26. In this case, the identification unit 26 is an example of the identification means according to the present invention and the detection unit 27 is an example of the detection means according to the present invention.

The card passage determination unit 28 has capabilities to control the start and end of read operations of the UV sensors 22 based on the detection signals from the object detection sensors 23 and determine whether a card has passed the card guide surface 20 successfully. The outcome determination unit 29 has a capability to determine the outcome of a card game based on information about the values (ranks) of cards from the card reader unit 7. The display control unit 30 has a capability to control display on the first display unit 9 and second display unit 10 while the communications control unit 31 has a capability to control the communications terminal 11. In this case, the outcome determination unit 29 is an example of the determination means according to the present invention.

The communications control unit 31 and communications terminal 11 are provided in the housing 5. Although it is assumed here by way of example that the communications control unit 31 is provided as a function of the control unit 8, the communications control unit 31 may be provided independently outside the control unit 8.

Operation of the table game system configured as described above will be described with reference to drawings. The code 2 read operation, which is an operation characteristic of the present invention, will be described here.

When a playing card 1 is shot out from the card shooter apparatus 4, each of the UV sensors 22 outputs an ON signal upon detection of a mark. The control unit 8 determines relative relationship between the two ON signals from the two UV sensors 22. This makes it possible to identify a difference in relative positions of the two marks detected by the two UV sensors 22. Then, the control unit 8 identifies card information (such as suit and rank information or group information) represented by the code 2, based on the difference in relative positions of the marks.

Now, correspondence between the outputs (ON signal outputs) of the two UV sensors 22 and the relative positional relationship of the two marks will be described with reference FIG. 9. As shown in FIG. 9, the mark positions have correspondence to the ON signals of the UV sensors 22. Consequently, a predetermined combination of two code elements 3 can be identified based on comparison results of relative changes in the ON signal outputs from the UV sensors 22. The memory 25 of the control unit 8 stores a comparative table which associates the 52 playing cards 1 with the 81 combinations provided by the code 2. This allows the computer (identification unit 26) of the control unit 8 to identify the code 2 on each card and read the rank and suit information of the playing card. The identification unit 26 may be provided independently outside the control unit 8.

In this case, the relative positions of the two marks in the column direction are detected by the object detection sensors 23. For example, in the case of a two row by two column code 2 such as shown in FIG. 1, when only the object detection sensor 23 on the upstream side in the card flow direction is on, the mark on the left side of the card is detected, and when only the object detection sensor 23 on the downstream side in the card flow direction is on, the mark on the right side of the card is detected. On the other hand, in the case of a three row by two column code 2 such as shown in FIG. 3, when the two object detection sensors 23 are both on, the marks on the center of the card are detected. In this way, the object detection sensors 23 output ON signals to detect the relative positions of the marks in the column direction and the UV sensors 22 output ON signals to indicate the presence of marks on the passing card. Since the code 2 is provided on edges of the playing cards 1, the UV sensors 22 can be placed in the card guide rails 21. This prevents the UV sensors 22 from malfunctioning due to extraneous light.

The table game system according to the present embodiment configured as described above makes it possible to read the code 2 from playing cards shot out at various speeds.

That is, according to the present embodiment, during reading of the code 2 which comprises the code elements 3 arranged in a matrix (at least two rows and two columns), the code elements 3 arranged in a row direction (orthogonal to the code reading direction) are read on a row by row basis. The code elements 3 include at least two types of mark which differ in length in the column direction (corresponding to the reading direction of the code 2) and the row-by-row combinations of the code elements 3 can be identified uniquely. Consequently, even if the playing cards 1 are shot out at various speeds, the suit and rank information of the playing cards 1 can be identified reliably based on the row-by-row combinations of the code elements 3. This makes it possible to read the code 2 from the playing cards shot out at various speeds.

Now, the feature of the present invention will be described more concretely. If one tries to provide unique "combinations of marks in the column direction" using two types of mark which differ in length in the column direction (reading direction of the code 2) as the code elements 3, some combinations are difficult to distinguish. For example, in the cases of both "short mark, no mark" and "no mark, short mark," the short marks are read by the same sensor (single sensor), making it difficult to distinguish between the two cases. Moreover, with two types of mark which differ in length in the reading direction of the code 2 (i.e., the direction in which the card is shot out), it becomes difficult to identify the types when the speed at which the card is shot out changes. For example, patterns of the sensor's detection signals are difficult to distinguish between the "long mark" when the card is shot out at high speed and the "short mark" when the card is shot out at low speed. This reduces the number of unique combinations of the marks (number of available combinations) accordingly, making it necessary to use a large number of marks and thereby complicating the code 2 and code reader.

In contrast, the present invention, which provides unique "combinations of marks in the row direction" using two types of mark which differ in length in the column direction (reading direction of the code 2) as the code elements 3, can distinguish two types of mark which differ in length in the column direction when viewed in the row direction (orthogonal to the reading direction of the code 2). For example, in the cases of "short mark, no mark" and "no mark, short mark," the short marks are read by different sensors, making it easy to distinguish between the two cases. This increases the number of unique combinations of the marks (number of available combinations) accordingly, requiring only a small number of marks and thereby simplifying the code 2 and code reader.

According to the present embodiment, the presence or absence of marks in each row or a combination of relative column-direction positions of the marks in each row and the types of the marks can be identified uniquely, and the suit and rank information of the playing cards 1 can be identified reliably based thereon. This makes it possible to reliably read the code 2 from the playing cards shot out at various speeds.

Also, according to the present embodiment, since the code 2 contains a group code, the group to which the playing cards 1 belong can be identified. This makes it possible to detect any playing card belonging to another group if used (fraudulently).

Also, according to the present embodiment, since the code 2 contains casino information, the casino in which the playing cards 1 are used can be identified. This makes it possible to detect any playing card belonging to another casino if used (fraudulently).

Also, according to the present embodiment, since the code 2 is placed point-symmetrically with respect to the center of the playing card 1, the code 2 can be read regardless of orientation of the playing card (even when the playing card 1 is upside down).

Also, according to the present embodiment, since the code 2 is printed in those locations of the playing cards 1 which do not overlap with suit and rank symbols, it is possible to prevent interference by the symbols on the playing cards 1 when reading the code 2.

Although an embodiment of the present invention has been described by way of example, the scope of the present invention is not limited to this, and various changes and modifications can be made in accordance with purposes within the scope of the appended claims.

As described above, the playing cards and the table game system according to the present invention have the advantage of allowing the code to be read reliably from the cards shot out at various speeds and are useful when used in baccarat and other table games.

What is claimed is:

1. Playing cards provided with a code not readable under a lighting condition of visible light, but readable under lighting conditions other than the visible light, wherein:

the code, which comprises a plurality of code elements arranged in at least two rows and two columns, represents at least suit and rank information of the playing cards;

the code elements include at least two types of mark which differ in length in a column direction corresponding to a reading direction of the code;

row-by-row combinations of the code elements arranged in a row direction orthogonal to the code reading direction can be identified uniquely; and the suit and rank information of the playing cards represented by the code can be identified based on the row-by-row combinations of the code elements.

2. The playing cards according to claim 1, wherein the row-by-row combinations of the code elements include the presence or absence of the marks in each row, or a combination of relative column-direction positions of the marks in each row and the types of the marks.

3. The playing cards according to claim 1, wherein the code represents information about a group to which the playing cards belong.

4. The playing cards according to any one of claim 1, wherein the code comprises the code elements arranged in three rows and two columns or arranged in two rows and three columns.

5. The playing cards according to any one of claim 1, wherein the group comprises a plurality of decks of the playing cards.

6. The playing cards according to any one of claim 1, wherein the code represents casino information unique to a casino in which the playing cards are used.

7. The playing cards according to any one of claim 1, wherein the code is located at least two locations on each of the playing cards point-symmetrically with respect to the center of the playing card.

8. The playing cards according to any one of claim 1, wherein the code is printed on the playing cards using a paint which is visualized upon exposure to ultraviolet radiation.

9. The playing cards according to any one of claim 1, wherein the code is printed in those locations of the playing cards which do not overlap with suit and rank symbols.

10. The playing cards according to any one of claim 1, wherein a blank space is provided between the code and edge of the playing card.

11. A table game system comprising playing cards and a card shooter apparatus, the playing cards being provided with a code not readable under a lighting condition of visible light, but readable under lighting conditions other than the visible light, and a card shooter apparatus having a capability to read the code out of the playing cards by being provided on a game table, wherein:

the code of the playing cards, which comprises a plurality of code elements arranged in at least two rows and two columns, represents at least suit and rank information of the playing cards;

the code elements include at least two types of mark which differ in length in a column direction corresponding to a reading direction of the code;

row-by-row combinations of the code elements arranged in a row direction orthogonal to the code reading direction can be identified uniquely;

the suit and rank information of the playing cards represented by the code can be identified based on the row-by-row combinations of the code elements; and the card shooter apparatus comprises:

a card guide unit which guides the playing cards drawn one by one out of a card receptacle unit onto the game table, at least two code sensors which is placed at locations corresponding to columns of the code elements on the playing cards guided and moved by the card guide unit, and read the code elements out of the playing cards on a row by row, an identification means which identifies the suit and rank information of the playing cards represented by the code based on the row-by-row combinations of the code elements read by the at least two code sensors, a determination means which determines results of a card game based on the suit and rank information of the playing cards identified by the identification means, and a first output means which outputs the results produced by the determination means.

12. The table game system according to claim 11, wherein:

the code can represent information about a group to which the playing cards belong;

the identification means can identify information about the group to which the playing cards belong based on the row-by-row combinations of the code elements read by the at least two code sensors; and the card shooter apparatus further comprises:

a detection means which detects playing cards not belonging to the group, based on the information about the group of the playing cards identified by the identification means, and a second output means which outputs detection results produced by the detection means.

13. The table game system according to claim 11, wherein:

each of the at least two code sensors outputs a detection signal corresponding to the read row-by-row combinations of the code elements; and the identification means identifies the suit and rank information of the playing cards represented by the code based on relative changes of the detection signals of the at least two code sensors.

14. The table game system according to any one of claim 11, wherein the first output means includes a monitor provided on a side of a housing of the card shooter apparatus.

* * * * *